US006766131B1

(12) United States Patent
Hiraoka et al.

(10) Patent No.: US 6,766,131 B1
(45) Date of Patent: Jul. 20, 2004

(54) LIQUID ELECTROPHOTOGRAPHIC DEVELOPING APPARATUS USING AIR PRESSURE TO HOLD LIQUID DEVELOPER THEREWITHIN

(75) Inventors: Yuji Hiraoka, Saitama (JP); Michio Matsumoto, Tokyo-Do (JP); Takeo Endo, Ciba (JP)

(73) Assignee: Aetas Technology Incorporated, Irvine, CA (US)

( * ) Notice: Subject to any disclaimer, the term of this patent is extended or adjusted under 35 U.S.C. 154(b) by 46 days.

(21) Appl. No.: 09/722,940

(22) Filed: Nov. 27, 2000

(30) Foreign Application Priority Data

Mar. 6, 2000 (TW) ..... 89103995 A

(51) Int. Cl.[7] ..... G03G 15/10
(52) U.S. Cl. ..... 399/246; 399/237; 399/247
(58) Field of Search ..... 399/233, 237, 399/241, 246, 247

(56) References Cited

U.S. PATENT DOCUMENTS 3,176,653 A * 4/1965 Hansen ..... 399/241
3,196,832 A * 7/1965 Zin ..... 399/247 X
3,484,162 A * 12/1969 Clark ..... 399/241
3,507,252 A * 4/1970 Leedom ..... 399/241
5,231,455 A * 7/1993 Day ..... 399/233 X
5,689,761 A * 11/1997 Denton et al. ..... 399/233 X
5,899,605 A * 5/1999 Caruthers et al. ..... 399/233 X
6,070,034 A * 5/2000 Hiraoka et al. ..... 399/233 X

* cited by examiner

*Primary Examiner*—Fred L. Braun
(74) *Attorney, Agent, or Firm*—Sonnenschein Nath & Rosenthal LLP

(57) ABSTRACT

A liquid electrophotographic developing apparatus including a developing unit with an elongated opening disposed adjacent to a photoreceptor and an air duct provided around the elongated opening. The air flow in the air duct has a predetermined air pressure to hold a liquid developer within a space substantially between the developing unit and the image-bearing surface while permitting toner particles in the liquid developer deposited on the image-bearing surface to be retained by the image—bearing surface and volatile solvent to be vaporized.

12 Claims, 3 Drawing Sheets

LIQUID ELECTROPHOTOGRAPHIC DEVELOPING APPARATUS USING AIR PRESSURE TO HOLD LIQUID DEVELOPER THEREWITHIN

FIELD OF THE INVENTION

The present invention relates to an electrophotographic developing apparatus for a copier or a printer, and more particularly, to a liquid electrophotographic developing apparatus in which leakage of liquid developers is prevented.

BACKGROUND OF THE INVENTION

Conventional liquid electrophotographic developing apparatuses bring a liquid developer into contact with an electrostatic latent image to be developed in any of several different ways. According to one method, the surface of a photoreceptor or other member carrying an electrostatic latent image is merely dipped into a bath of a liquid developer to develop the electrostatic latent image.

In another method, such as described in U.S. Pat. No. 5,017,968, a liquid developer is supplied to a head which extends across the width of a member bearing an electrostatic latent image and the liquid developer is supplied through one channel in the head to a slot opening where it is brought into contact with the surface of the image-bearing member. The liquid developer is then withdrawn from the slot opening through another channel in the developing head.

In a further liquid developing arrangement, as shown in U.S. Pat. No. 5,708,937, a rotating cylinder is coated with a liquid developer at a supply point and carries the developer into contact with the image-bearing member to develop the image. Other apparatuses for supplying a liquid developer to an image-bearing member through a slot extending across the width of the member are disclosed in U.S. Pat. Nos. 5,708,936, 5,737,672 and 5,765,078.

Such apparatuses for supplying a liquid developer to an image-bearing member have certain disadvantages including generation of odors resulting from vaporization of the liquid developer within the region of the developing unit, difficulties in reproducing colored images with successive developers of different colors in a single pass of the image-bearing member, and excessive size and cost of the developing units.

On the other hand, U.S. Pat. Nos. 5,358,659, 5,567,564 and 5,667,716 disclose methods of preparing magnetic liquid developers while U.S. Pat. No. 4,797,013 discloses the use of ferrofluids retained by magnets in gaps between moving members to seal lubricants in bearing arrangements. U.S. Pat. No. 4,645,960 discloses a ferrofluid bearing. U.S. Pat. No. 5,461,466 discloses a dripless seal for a liquid toner cartridge by which the cartridge is closed when not in use.

SUMMARY OF THE INVENTION

An object of the present invention is to set forth a liquid developing apparatus of electrostatic latent images that overcomes disadvantages of the prior art.

Another object of the present invention is to provide a liquid developing apparatus that minimizes emission of vapor from a liquid developer into the surrounding atmosphere.

A further object of the present invention is to provide a liquid developing apparatus that facilitates multicolor development of electrostatic images in a single pass of an image-bearing member.

An additional object of the present invention is to provide a compact and inexpensive liquid developing apparatus.

According to one aspect of the present invention, a liquid developing apparatus comprises:

a developing unit, having an elongated opening disposed adjacent to a moving image-bearing surface of a photoreceptor, for converting an electrostatic latent image into a toner image; and an air duct, provided around the elongated opening of the developing unit, containing air flow therein having a predetermined air pressure to hold a liquid developer within a space between the developing unit and the image-bearing surface while permitting toner particles in the liquid developer deposited on the image-bearing surface to be retained by the image-bearing surface and allowing volatile solvent in the developer to be vaporized into the surrounding atmosphere.

According to another aspect of the present invention, a liquid developing apparatus comprises:

a plurality of developing units, each having an elongated opening disposed adjacent to a moving image-bearing surface of a photoreceptor which passes adjacent to the plurality of developing units in succession, for converting an electrostatic latent image into a toner image, each of the plurality of developing units containing a liquid developer of a different color; and a plurality of air ducts, each provided around the elongated opening of the developing unit, containing air flow therein having a predetermined air pressure, for causing the liquid developer to be retained adjacent to the elongated opening in the developing unit while depositing toner particles on an electrostatic latent image on the image-bearing surface of the photoreceptor as the photoreceptor moves adjacent to the elongated opening.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION

Figure 1:
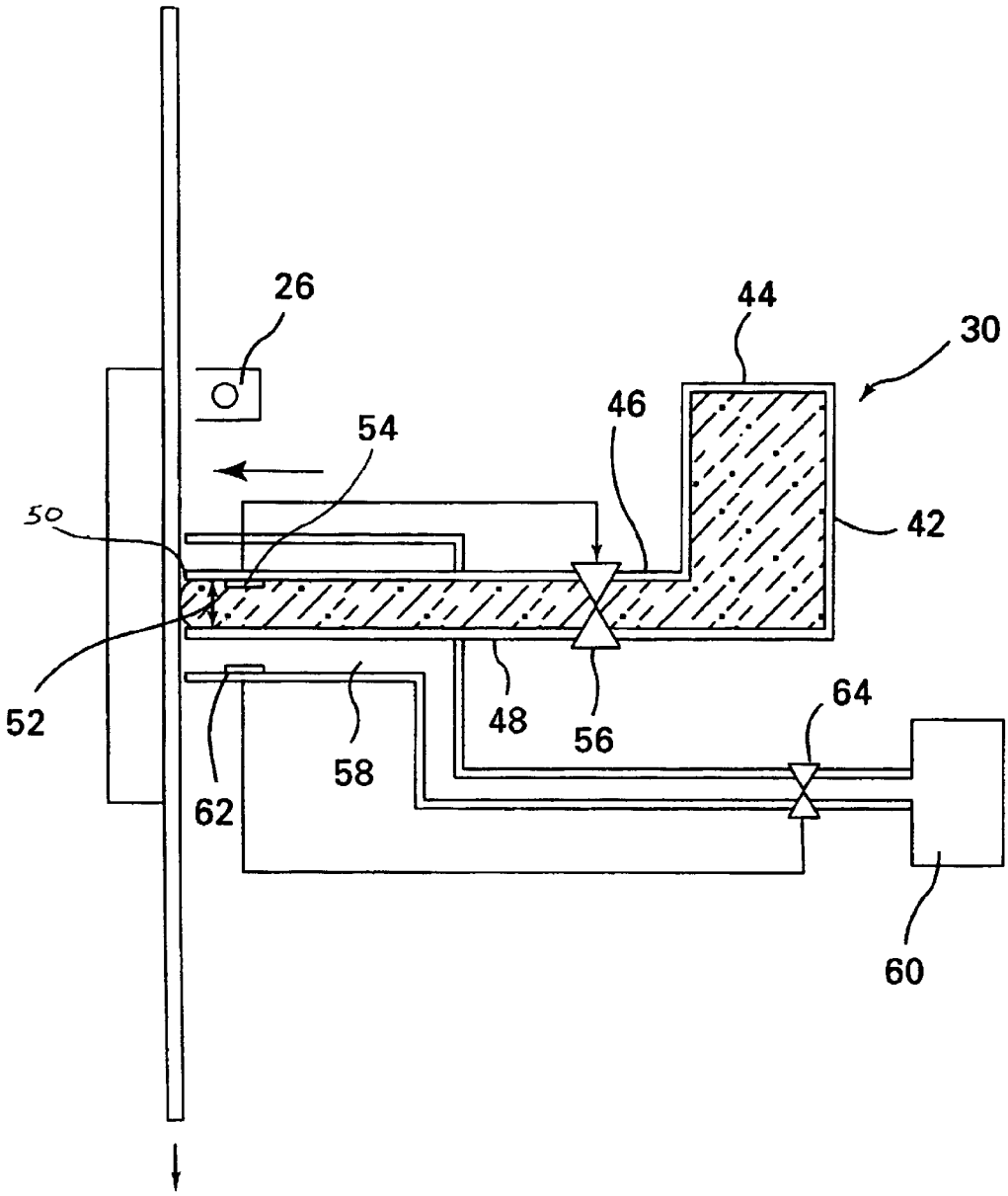
FIG. 1 is a sectional view of a liquid developing apparatus according to an embodiment of the present invention.
Figure 2:
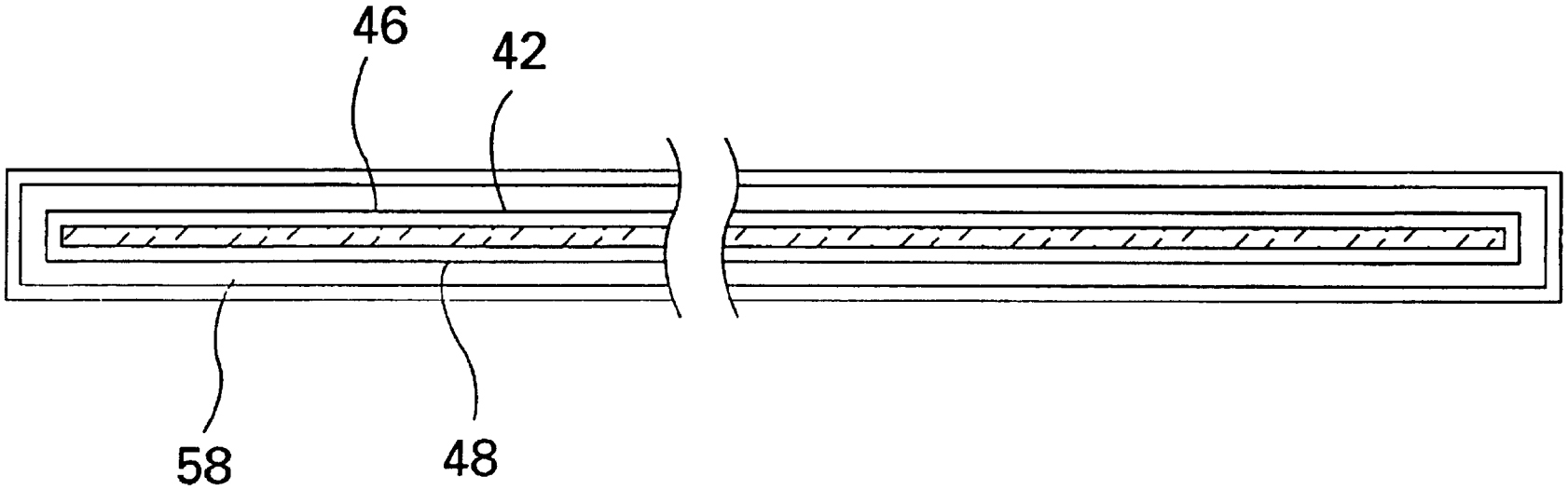
FIG. 2 is a plan view showing an elongated developing head of the liquid developing apparatus in FIG. 1.
Figure 3:
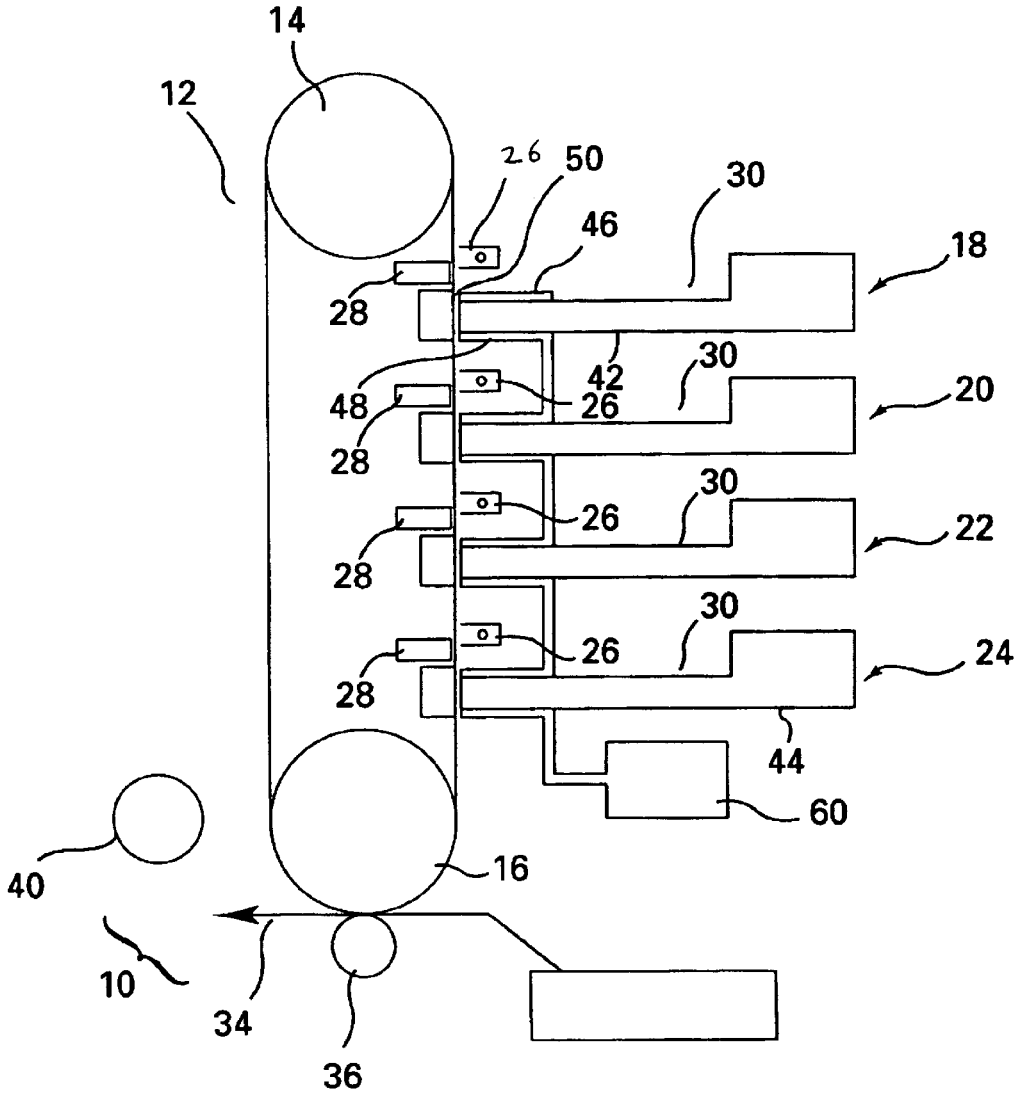
FIG. 3 is a view four liquid developing apparatuses used in an electrophotographic system.

In a preferred embodiment of the present invention illustrated in FIGS. 1–3, an electrophotographic system 10 includes a belt-type photoreceptor 12 conveyed in the direction of the arrows in an endless loop around two spaced rollers 14 and 16. In order to produce a multicolor image, four printing stations 18, 20, 22 and 24 are disposed adjacent to the photoreceptor along a straight path of the photoreceptor belt. Each printing station includes a charging unit 26, an exposing unit 28 and a developing unit 30 and all of the printing stations are identical except that the four developing units 30 contain different colored liquid developers, for example, yellow (Y), magenta (M), cyan (C) and black (K).

As the photoreceptor 12 is driven past each printing station in its loop-shaped path, it is first charged by the charging unit 26 and then exposed by the exposure unit 28 to produce an electrostatic latent image appropriate for the particular color to be applied by that printing station and the image is then developed by the developing unit 30 with the correspondingly colored liquid developer. After all of the colored images have been printed, a medium 34 such as paper sheet or transparency is brought into contact with the surface bearing the colored image at a transfer station 36 so that the colored image is transferred to the medium 34 and the surface of the photoreceptor is thereafter cleaned at a cleaning station 40 in preparation for formation of the next colored image.

As known from FIG. 1, a liquid developer 42 in a reservoir 44 is supplied to the surface of the photoreceptor 12 between closely spaced parallel plates 46 and 48 which form a narrow gap 50 with the photoreceptor surface, permitting the liquid developer to come into contact with the surface during its motion in the direction of the arrow for a sufficient distance 52 to permit toner particles to be withdrawn from the developer liquid and adhered to the charged regions of the surface of the photoreceptor to produce a toner image. A flow control mechanism for maintaining the developer at a proper constant pressure is provided between the parallel plates 46 and 48, and in this embodiment, it comprises a flow pressure sensor 54 and a control valve 56.

An air duct 58 is provided around the parallel plates 46 and 48, and an air flow therein comes from a pump 60, having an air pressure controlled by an air pressure control mechanism comprising an air pressure sensor 62 and a flow control valve 64. According to the present invention, preferably, solvent for the developer is innocuous and volatile liquid such as water, alcohol and other organic solvents. As a result, toner particles in the liquid developer can be adhered to an electrostatic latent image on the surface of the photoreceptor 12 by adjusting pressures of the liquid developer 42 and air flow, while any developer material which is not bound to the photoreceptor surface is retained within the developing unit 30, thus preventing escape of other components of the liquid developer. In this way, both liquid and solid developer components are prevented from being transported on the surface of the photoreceptor to contaminate subsequent images of other colors.

In order to ensure a continuous supply of toner particles to the photoreceptor surface, the liquid developer 42 may be circulated from the reservoir 44 to the gap 50 by a conventional pumping arrangement.

On the other hand, the charge on the toner particles in the liquid developer 42 should be of the correct polarity and strong enough to be retained on the surface of the photoreceptor by the electrostatic charges in the image. Such control of the polarity and magnitude of the charge on the toner particles can be effected in conventional ways known to those skilled in the art, and the details thereof are omitted.

The gap 50 and the gap 52 should be about the same size, preferably between about 0.1 mm and about 1 mm. The size of the gaps depends on the processing speed and should be decreased as the processing speed is increased.

With the apparatus described, the developing units 18, 20, 22 and 24 can be both compact and inexpensive to manufacture. Moreover, the developing apparatus of the present invention permits highly efficient one-pass multicolor processing because the adhering force between the toner particles and the electrostatic latent image can be controlled so as to be strong enough to overcome any tendency of the toner particles to be dislodged from the photoreceptor by the motion of the photoreceptor surface.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A liquid electrophotographic developing apparatus, comprising:

a developing unit, having an elongated opening disposed adjacent to a moving image-bearing surface of a photoreceptor, for converting an electrostatic latent image into a toner image; and an air duct, provided around the elongated opening of the developing unit, containing air flow therein having a predetermined air pressure to hold a liquid developer within a space between the elongated opening and the image-bearing surface while permitting toner particles in the liquid developer deposited on the image-bearing surface to be retained by the image-bearing surface and allowing volatile solvent in the developer to be vaporized into the surrounding atmosphere.

2. The liquid electrophotographic developing apparatus according to claim 1, wherein the air duct is provided with air pressure control means for maintaining the air flow at a predetermined pressure.

3. The liquid electrophotographic developing apparatus according to claim 2, wherein the air pressure control means comprises an air pressure sensor and a flow control valve.

4. The liquid electrophotographic developing apparatus according to claim 1, wherein the developing unit is provided with flow control means for controlling flow of the liquid developer.

5. The liquid electrophotographic developing apparatus according to claim 4, wherein the flow control means comprises a flow pressure sensor and a control valve.

6. A liquid electrophotographic developing apparatus, comprising:

a plurality of developing units, each having an elongated opening disposed adjacent to a moving image-bearing surface of a photoreceptor which passes adjacent to the plurality of developing units in succession, for converting an electrostatic latent image into a toner image, each of the plurality of developing units containing a liquid developer of a different color; and a plurality of air ducts, each provided around the elongated opening of a respective one of the plurality of developing units, containing air flow therein having a predetermined air pressure, for causing the liquid developer to be retained within a space between the elongated opening and the image-bearing surface in the developing unit while depositing toner particles on an electrostatic latent image on the image-bearing surface of the photoreceptor as the photoreceptor moves adjacent to the elongated opening.

7. The liquid electrophotographic developing apparatus according to claim 6, wherein the air duct is provided with air pressure control means for maintaining the air flow at a predetermined pressure.

8. The liquid electrophotographic developing apparatus according to claim 7, wherein the air pressure control means comprises an air pressure sensor and a flow control valve.

9. The liquid electrophotographic developing apparatus according to claim 6, wherein the developing unit is provided with flow control means for controlling flow of the liquid developer.

10. The liquid electrophotographic developing apparatus according to claim 9, wherein the flow control means comprises a flow pressure sensor and a control valve.

11. A liquid electrophotographic developing apparatus, comprising:

a developing unit, having an elongated opening disposed adjacent to a moving image-bearing surface of a photoreceptor, for converting an electrostatic latent image into a toner image; and an air duct, provided around the elongated opening of the developing unit, containing air flow therein having a predetermined air pressure to hold a liquid developer within a space substantially between the elongated opening and the image-bearing surface while permitting toner particles in the liquid developer deposited on the image-bearing surface to be retained by the image-bearing surface and allowing volatile solvent in the developer to be vaporized into the surrounding atmosphere, wherein the air duct is provided with air pressure control means for maintaining the air flow at a predetermined pressure, the air pressure control means comprising an air pressure sensor and a flow control valve.

12. A liquid electrophotographic developing apparatus, comprising:

a developing unit, having an elongated opening disposed adjacent to a moving image-bearing surface of a photoreceptor, for converting an electrostatic latent image into a toner image; and an air duct, provided around the elongated opening of the developing unit, containing air flow therein having a predetermined air pressure to hold a liquid developer within a space substantially between the elongated opening and the image-bearing surface while permitting toner particles in the liquid developer deposited on the image-bearing surface to be retained by the image-bearing surface and allowing volatile solvent in the developer to be vaporized into the surrounding atmosphere, wherein the air duct is provided with air pressure control means for maintaining the air flow at a predetermined pressure, the air pressure control means comprising an air pressure sensor and a flow control valve;

wherein the developing unit is provided with flow control means for controlling flow of the liquid developed, the flow control means comprising a flow pressure sensor and a control valve.

* * * * *